United States Patent [19]

Lyman

[11] Patent Number: 4,466,677

[45] Date of Patent: Aug. 21, 1984

[54] VACUUM CLEANER HOSE MANUFACTURE

[75] Inventor: John B. Lyman, Bloomington, Minn.

[73] Assignee: Whirlpool Corporation, Benton Harbor, Mich.

[21] Appl. No.: 25,406

[22] Filed: Mar. 30, 1979

[51] Int. Cl.[3] ..... H01R 13/50

[52] U.S. Cl. ..... 339/15; 339/16 R; 339/218 M

[58] Field of Search ..... 339/15, 16 R, 97 R, 339/276 T, 27 B, 218 R, 218 C, 218 M; 174/47; 264/272

[56] References Cited

U.S. PATENT DOCUMENTS

| | | | |
|---|---|---|---|
| Re. 29,666 | 6/1978 | Reynolds et al. | 339/15 |
| 2,516,864 | 8/1950 | Gilmore et al. | 174/47 |
| 3,034,085 | 5/1962 | Pauler et al. | 339/16 |
| 3,127,227 | 3/1964 | Edwards | 339/15 |
| 3,314,039 | 4/1967 | Opper | 339/15 |
| 3,611,257 | 10/1971 | Carkhuff | 339/218 M X |
| 3,636,285 | 1/1972 | Wickham et al. | 339/27 B |
| 3,683,319 | 8/1972 | Vigeant et al. | 339/97 R |
| 3,848,954 | 11/1974 | Sedlacek | 339/97 R |
| 3,928,715 | 12/1975 | Holden | 339/15 |
| 4,162,370 | 7/1979 | Dunn et al. | 339/15 X |

*Primary Examiner*—John McQuade

*Attorney, Agent, or Firm*—Wood, Dalton, Phillips, Mason & Rowe

[57] ABSTRACT

A vacuum cleaner hose manufacture wherein terminals are secured to the ends of a pair of helical wires included in the hose carcass. The terminals are maintained in accurate spaced relationship and in accurate relationship to the centerline of the hose carcass through the use of an improved terminal holder. The holder receives connecting portions of the terminals to maintain them in the desired accurate spaced relationship. A mold provided for molding the hose connector about the hose ends with the terminal holder and terminals included therein includes aligning structure for engagement with the holder or the terminals themselves to effect the desired alignment of the terminals with the axis of the hose carcass. The holder may be provided with a pair of through openings for receiving the connecting portions of the terminals for facilitated manufacture of the hose end construction. The holder is retained in the molded hose end and functions to maintain the desired accurate spacing and alignment with the hose axis upon removal from the mold. The terminals include wedging portions adapted to slice through the hose conductor insulation and into positive metal-to-metal engagement with the conductors for effecting the desired electrical connection of the terminals to the hose conductors or wires.

10 Claims, 7 Drawing Figures

FIG. 6
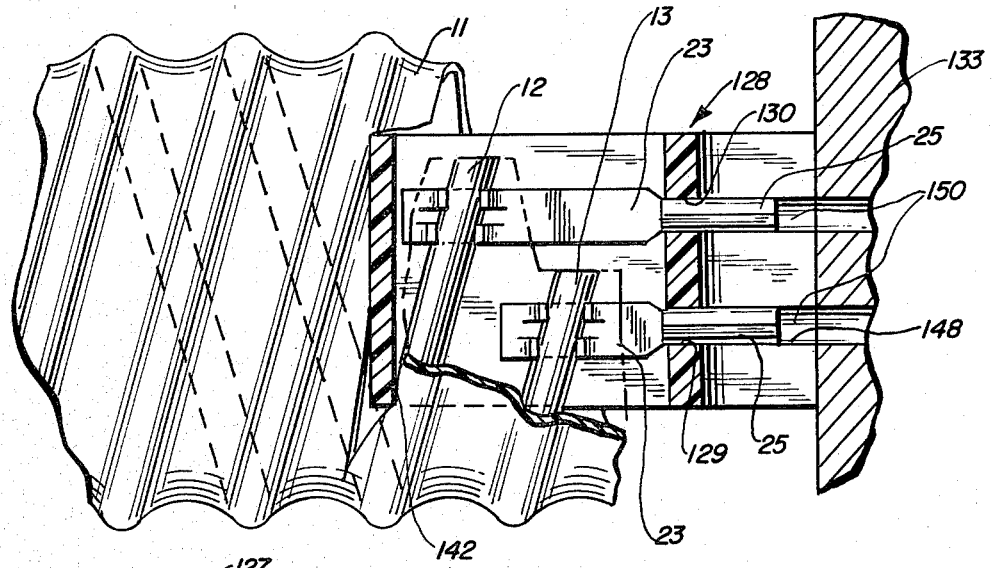
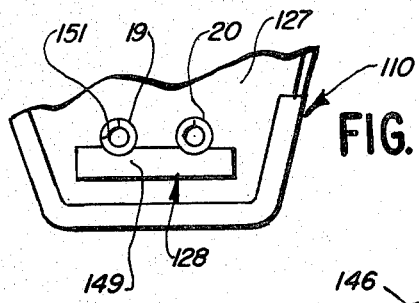
FIG. 7
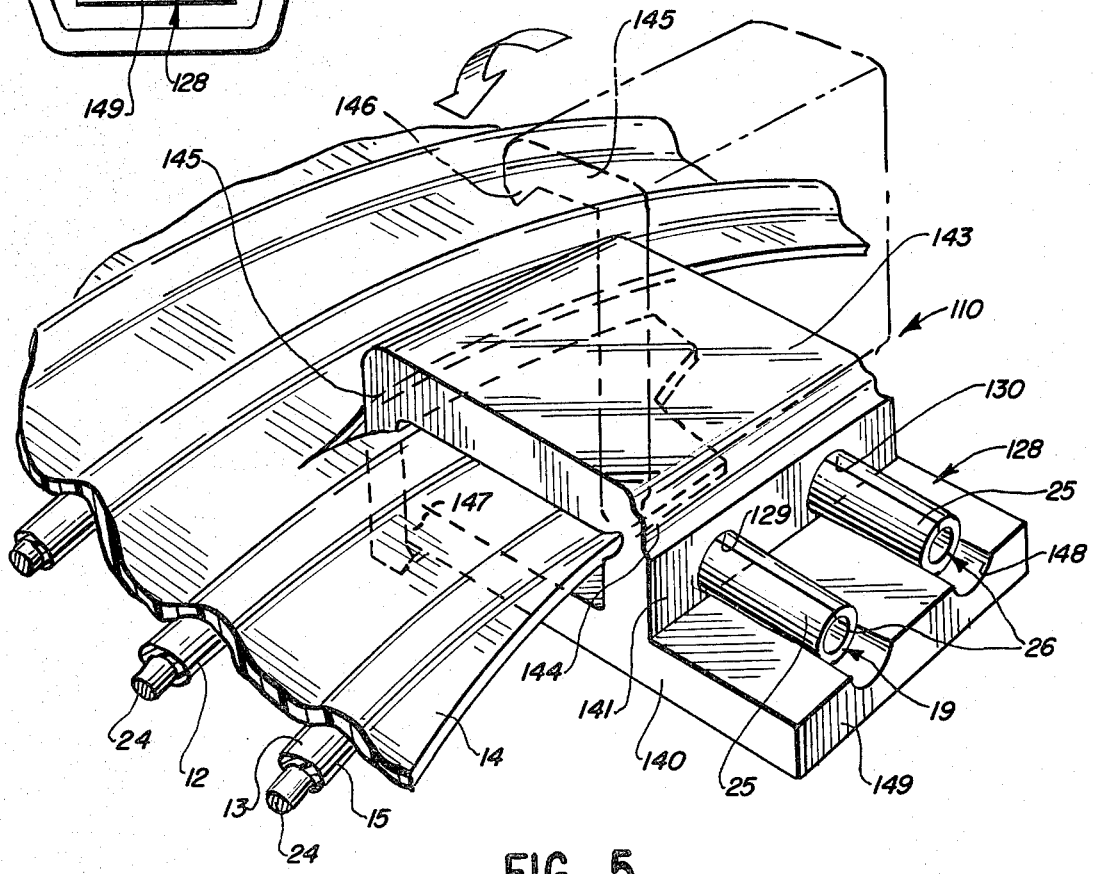
FIG. 5

VACUUM CLEANER HOSE MANUFACTURE

BACKGROUND OF THE INVENTION

1. Field of the Invention

This invention relates to vacuum cleaner hose manufacture, and in particular to the manufacture of a hose end for use with press-on terminals utilizing sharp wedging means for effecting the desired electrical connection of the terminals to the hose conductors or wires.

2. Description of the Background Art

A vacuum cleaner hose and structure is presently in public use in the vacuum cleaner manufacture industry wherein a hose end connector or cuff is molded about a pair of terminals wedged onto the ends of a pair of helically extending electrical conductors included in the hose carcass. Such construction has been found to sometimes result in an inaccurately spaced disposition of the terminals and inaccurate disposition thereof relative to the longitudinal axis of the hose for a number of reasons. It has been found that it is difficult to maintain the alignment of the terminals because of the springy nature of the electrical conductors which advantageously may be fabricated using copper coated spring steel wire and which serve both as means for conducting the electrical current through the hose and spring reinforcing means of the hose carcass. Thus, while the terminals may be temporarily retained in the desired disposition in the mold by suitable mold formation, such springiness has been found to cause undesirable movement of the terminals upon removal of the newly formed hose end from the mold as the molding material, at this stage in the manufacture, it is relatively soft and yielding.

As the terminals must be accurately located for proper fit with a complementary terminal structure in connecting the hose and electrically to a complementary fitting, such misalignment of the terminals may present a serious problem.

One solution to this problem is to retain the molded hose end in the mold for a sufficiently long time to permit substantial rigidification of the molded material before removal therefrom. Such a solution has the serious disadvantage of substantially increasing cost because of the reduction in rate of manufacture.

The mechanical connection of the terminals to the hose conductors causes the terminals to be supported in part by the hose conductors which, as discussed above, may cause the terminals to have an undesirable skewed relationship with each other and with the hose axis. Where the hose end is molded about such terminals without providing any further support thereto, the hose end may be inoperative for the purposes intended, thus causing a relatively high scrap rate in the manufacturing process. Where the terminals are maintained temporarily in the desired aligned disposition during the molding operation, they may temporarily be properly aligned but become misaligned as a result of the forces acting thereon developed by the springiness of the hose wires.

The concept of utilizing the molded hose end for providing the sole support (excepting the support provided by the hose conductors) for the electrical connectors is disclosed in Wickham et al U.S. Pat. No. 3,636,285 which further teaches that the electrical devices which are embedded in the hose connector plastic may be male or female connectors as well as electrical switches.

In U.S. Pat. No. 2,516,862, A. W. Gilmore et al show a method of making a vacuum cleaner hose wherein a female electrical connector is provided in a molded-on sleeve at the end of the hose carcass.

In U.S. Pat. No. 3,127,227 of Charles E. Edwards, the hose connector consists of inner and outer sleeves formed of plastic material for jointly locking the electrical fitting in place at the end of the hose carcass.

Lincoln I. Opper, In U.S. Pat. No. 3,314,039, shows a vacuum cleaner hose connection wherein a pair of terminals are embedded in a plastic collar which serves as the sole support for the terminals. The collar is slid over the projecting portion of an inner sleeve into abutment with a shoulder on the sleeve with hollow wire ends on the collar sliding into electrical connection with the ends of the wire of the hose carcass.

Charles J. Pauler et al, in U.S. Pat. No. 3,034,085, which patent is owned by the assignee hereof, show a vacuum cleaner hose construction wherein the terminals are retained by a collar.

The concept of utilizing sharp edge wedge-type terminal connections which slice through to the conductor wires is shown in U.S. Pat. No. 3,683,319 of George H. Vigeant et al.

Another patent showing the use of a sharp edge notch-type connector is that of William S. Sedlacek, U.S. Pat. No. 3,848,954, which teaches the use of a notch having relatively sharp corner edges preceding the slot so as to permit cutting of the insulation as the wire is brought downwardly into the slot.

SUMMARY OF THE INVENTION

The present invention is concerned with the problem of maintaining accurate alignment of the electrical terminals of such hose end structures wherein the terminals are mechanically supported by the springy electrical conductors of the hose carcass as a result of being wedged onto the ends of the wires. The terminals may include a portion defining sharp slots for cutting through the wire insulation and forming secure mechanical and electrical connections to the hose wire ends. The invention comprehends providing a support which is adapted to receive the substantially cylindrical connecting portion of the terminals so as to cooperate with the support of the terminals provided by the connection thereof to the hose wire ends and the support of the terminals provided by the subsequently molded-on hose end connector or cuff in providing an arrangement of the terminals which is maintained accurately in parallel alignment with the axis of the hose end so as to provide an improved low cost simple terminal construction.

In one form, the terminal holder, which is sometimes referred to as a substrate, comprises a molded plastic element having a pair of through openings accepting the substantially cylindrical portions of the terminals. A larger diameter recess is provided for receiving a dowel pin of the mold which may be accurately aligned with the axis of the hose and mounted in a complementary portion of the mold so as to accurately retain the terminals not only in parallel relationship to each other but also accurately parallel to the axis of the hose end. The terminal holder may be molded from a suitable support material and may advantageously be formed using a rigid vinyl material which is relatively hard as compared to the hose end connector or cuff molded around the terminal holder. The rigidity and harness of the terminal holder or substrate facilitates maintaining the hose terminals in the desired disposition.

In another form, the terminal holder may include a movable portion adapted to be snapped over the portions of the terminals connected to the hose wire ends so as to effectively retain the terminals on the wire ends as during the molding operation.

The terminals may comprise suitable conventional terminals such as disclosed in Reynolds et al U.S. Pat. No. 29,666, or other suitable conventional terminals. The use of the low cost simple terminal holder structure provides a positive alignment of the terminals notwithstanding any tendency of the springy hose wire to displace the terminals upon completion of the mechanical electrical connection thereto. Further, as the holder has a relatively large outer surface area, the holder is effectively positively accurately maintained in the molded-on cuff notwithstanding the somewhat yielding characteristics of the cuff material at the time of completion of the molding operation and for some time following.

Thus, the invention comprehends an improved vacuum cleaner hose structure wherein press-on terminals are adapted to be installed quickly and efficiently by the knife edges thereof cutting through the insulation of the hose wire conductors so as to permit a simple press-on operation to provide a positive engagement of the hose wires by the terminals, assuring a positive electrical connection therebetween.

The invention further comprehends that the support of the terminals be further effected by the holder so as to assure a maintained accurate parallel spacing therebetween and by the support of the terminals and terminal holder in the molded-on cuff so as to provide a further maintained accurate positioning of the terminals relative to the hose end. Thus, the present invention provides a substantial improvement over the prior art hose connectors wherein the individual terminals are supported only by the springy conductor wire ends and the molded cuff portion of the hose connector.

The invention further comprehends an improved low cost method of forming a hose connector in permitting the mold to be provided with aligning means such as dowels receivable in the female connector portion of the terminals or, as discussed above, in a separate, relatively large recess of the holder. Thus, the mold may be utilized as means for effecting the desired accurate alignment of the terminals in the completed hose construction.

The holders of the present invention may be formed of low cost materials, such as a molded synthetic resin, for example, a rigid vinyl, and thus the vacuum cleaner hose structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 5 is a fragmentary perspective view of a modified form of hose and structure embodying the invention;

FIG. 6 is an elevation with a portion broken away illustrating the arrangement of the structure of FIG. 5 in the mold for providing the molded-on hose connector thereabout; and FIG. 7 is a fragmentary end elevation of the completed hose end structure of the embodiments of FIGS. 5 and 6.

DESCRIPTION OF THE PREFERRED EMBODIMENTS

Figure 2:
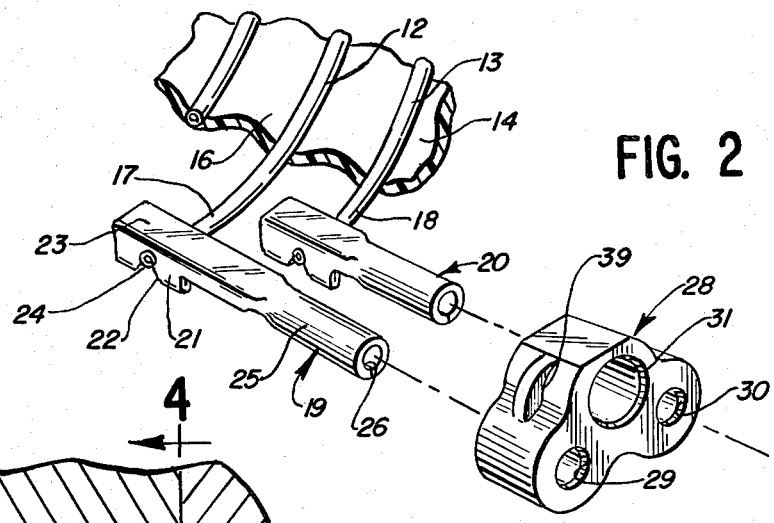
FIG. 2 is an exploded view illustrating the connection of the holder to the terminals previously connected to and supported by the hose wire ends.

In the exemplary embodiment of the invention as disclosed in FIGS. 1-4 of the drawing, a vacuum cleaner hose structure generally designated 10 is shown to comprise an improved hose end structure adapted for mechanically connecting the hose 11 to associated conventional vacuum cleaner attachments and providing an electric power supply thereto through a pair of electrical conductors 12 and 13 extending helically in the carcass 14 of the hose. Electrical conductors 12 and 13 comprise conventional spring wire-type conductors having an outer layer of insulation 15. As shown in FIG. 2, the electrical conductors 12 and 13 are bonded to the inner surface portion 16 of the carcass, and the ends 17 and 18 thereof may be brought out from the carcass so as to be engaged by suitable electrical terminals 19 and 20 in providing an electrical connection at the hose end.

As shown in FIG. 2, the terminals 19 and 20 may comprise suitable conventional terminals such as disclosed in Reynolds et al U.S. Pat. No. 29,666, each having a pair of sidewalls 21 provided with a sharp-edged slot 22. The slot may be generally U-shaped as shown in the Reynolds et al patent referred to above, permitting the terminal end 23 provided with the sidewall 21 to be pressed onto the insulated wire with the sharp edge of the slot cutting through the insulation and engaging the metal conductor 24 of the wire so as to provide a firm and positive mechanical and electrical connection between the terminal and the wires.

In the illustrated embodiment, each terminal further defines a female connection portion 25. The connecting portions, as shown in FIG. 2, are right circularly tubular as shown, defining a cylindrical axial recess 26 for receiving a conventional male prong of a conventional complementary male connector. The connecting portions 25 may also be "D" shaped in section as well known in the art. The invention is disclosed with reference to the use of female connecting portions 25. However, as will be obvious to those skilled in the art, the inventive concept of the present invention may be utilized similarly, where desired, to provide the terminals 19 and 20 with male connecting portions comprising longer extending tubular portions will balled ends instead of the portions 25.

As discussed briefly above, the connection of the portions 23 of the terminals 19 and 20 to the electical conductors 12 and 13 effectively permits the electrical conductors to provide some support to the terminals in the hose end structure 10. However, as discussed above, because of the substantial springiness of the metal portion 24 of the wires, it is difficult to maintain the terminals in the desired accurate spaced aligned relationship particularly just after the molding of the outer cuff 27 to the hose end while the thermoplastic cuff material is still somewhat soft. The present invention comprehends the provision of an improved support device generally designated 28 comprising a terminal holder or substrate having a pair of through openings 29 and 30 into which the cylindrical connection portion 25 of each of the terminals 19 and 20 is inserted prior to the molding operation. The terminal holder 28 may be formed of a molded synthetic resin such as relatively hard rigid vinyl and, thus, is extremely simple and economical of construction while yet providing a positive maintained alignment of the terminals at all times including prior to, during, and after the molding operation.

Figure 3:
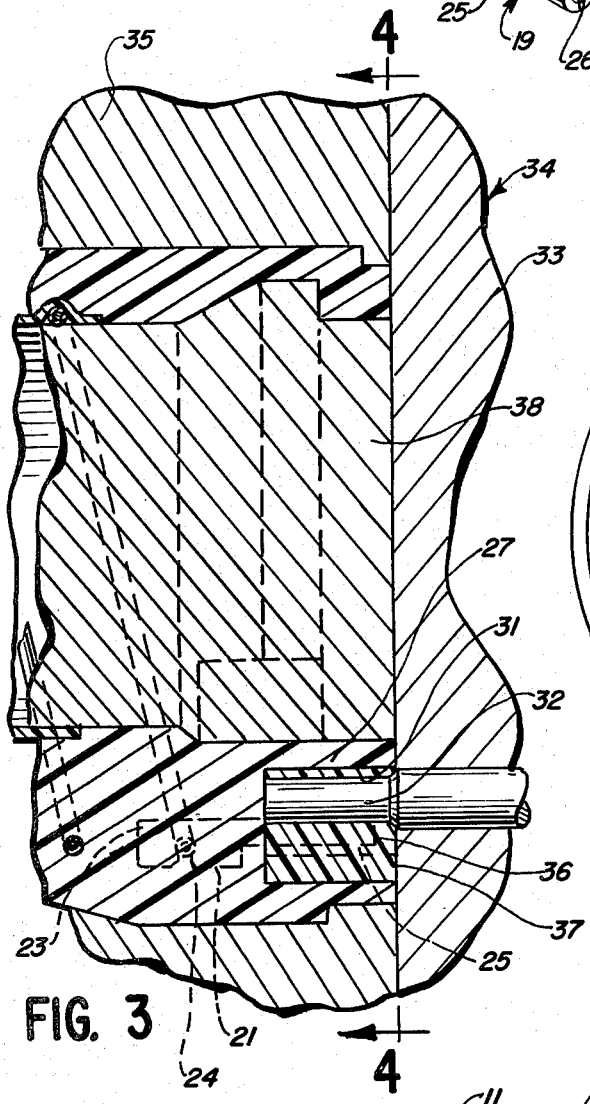
FIG. 3 is a fragmentary enlarged vertical section taken substantially along the line 3—3 of FIG. 4 and illustrating the arrangement of the structure in the mold.
Figure 4:
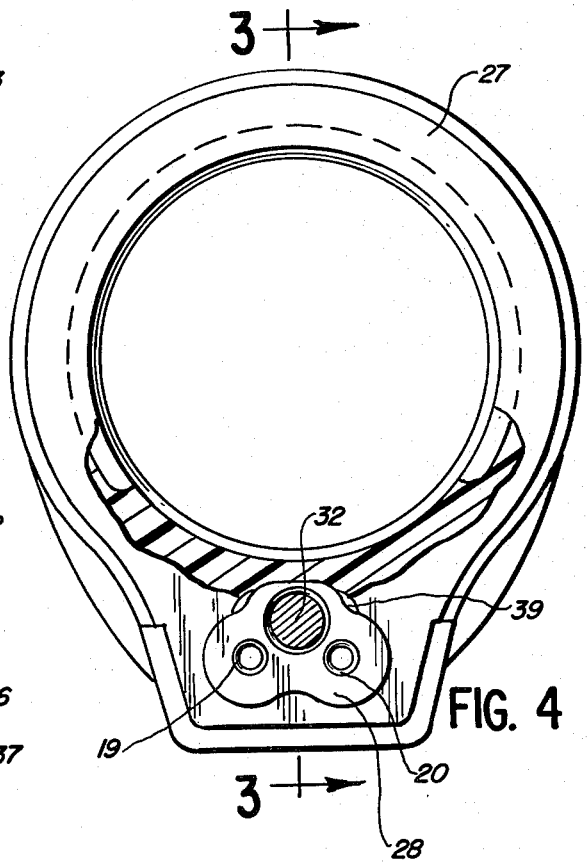
FIG. 4 is a section taken substantially along the line 4—4 of FIG. 3.
Figure 1:
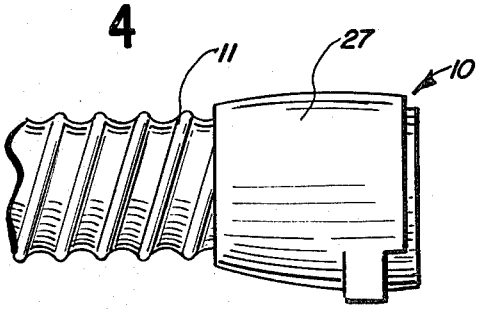
FIG. 1 is a side elevation of a vacuum cleaner hose end structure embodying the invention.

As further seen in FIG. 2, the terminal holder 28 is provided with a relatively large diameter recess 31. As shown in FIG. 3, recess 31 is adapted to receive a dowel pin 32 carried by wall 33 of the mold 34 provided for forming the molded hose connector or cuff 27. A complementary mold part 35 is arranged to hold the end of the hose 11 axially parallel to the dowel pin 32.

As shown in FIG. 3, the distal end 36 of the connection portion 25 of the terminals terminates short of the front surface 37 of holder 28 so as to be effectively recessed somewhat within the openings 29 and 30 in accord with Underwriter's Laboratories vacuum cleaner hose connector requirements. The mold may include an axial portion 38, as shown in FIG. 3.

Thus, when the terminal holder or substrate 28 is installed on pin 32, front face 37 thereof may be flush with mold portion 33, permitting the cuff 27 to be molded about the holder and exposed portion 23 of the terminals 19 and 20 with the terminals being maintained accurately in aligned, parallel spaced relationship to each other and parallel to the axis of the hose end as a result of the aligning function of the dowel pin 32 in the holder recess 31.

As shown in FIG. 2, terminal holder 28 may be provided with webs 39 projecting laterally therefrom so as to effectively lock the holder in the molded-on cuff 27 against displacement outwardly from the cuff parallel to the axis of the hose.

The present invention is not limited to the terminals shown and described herein, or to the method of attaching the terminals to the vacuum cleaner hose wires or conductors shown and described herein. Any suitable terminals may be used, and any suitable method for positively attaching the terminals to the hose wires may be used including soldering of the terminals to the electrically conducting wires included in the vacuum cleaner hose structure.

Referring now to the embodiment of FIGS. 5–7, a modified form of vacuum cleaner hose structure generally designated 110 is shown to comprise a hose end structure similar to structure 10, but utilizing a modified terminal support device, or holder, 128. As best seen in FIG. 5, holder 128 includes a base portion 140 having an upstanding wall portion 141 provided with through openings 129 and 130 through which the connecting portions 25 of the terminals 19 and 20 are passed.

As seen in FIG. 6, the end of the hose 11 is provided with a slit 142. The terminal portions 23 are connected to the hose wires 12 and 13 similarly as in the embodiment of FIGS. 1–5. Holder 128, however, includes a cover portion 143 connected to the upper end of wall portion 141 by a flexible hinge portion 144. The cover includes a distal turned flange 145 provided with a latching shoulder 146.

As shown in FIG. 5, the cover extends normally upwardly from the wall 141. After the terminal portions 25 are passed under the openings 129 and 130 of wall 141, the cover is swung downwardly to the position shown in full lines in FIG. 5, with the latching shoulder 146 latching under the rear portion 147 of base 140 so as to further retain the terminal portions 23 in positive mechanical and electrical connection to the metal conductors of the wires 12 and 13.

As shown in FIG. 5, the base may be provided with a pair of semicylindrical recesses 148 for partially receiving the cylindrical terminal connection portions 25, thereby further guiding the terminals in the desired parallel aligned relationship illustrated in FIG. 6.

The front end of base 140 defines a forward surface 149 which is abutted to the mold portion 133. Mold portion 133 is provided with a pair of small diameter dowel pins 150 which are received in the openings 26 of the terminals 19 and 20 so as to further maintain the terminals and holder 128 in aligned relationship parallel to the axis of the hose end.

The cuff may be molded about the hose end with the terminals and holder secured thereto, as shown in FIG. 6. In the completed hose end shown fragmentarily in FIG. 7, end face 149 of the terminal holder 128 is exposed in underlying relationship to the ends of the terminals 19 and 20, which are suitably recessed within openings 151 in a manner similar to the terminals in the hose structure 10. The substantial transverse surfaces of the wall 141 and cover 143 function further to prevent lateral translation of the holder in the molded cuff material during the rigidification thereof, assuring that the terminals are maintained accurately in parallel alignment and parallel to the axis of the end of the hose. Thus, the holder 128 is similar to and functions generally similar to holder 28 except for the provision of the additional retaining means defined by the rear portion of the base and the cover which provides still further maintained alignment of the terminal structure in the hose structure 110. Elements of hose structure 110 which are similar to corresponding elements of hose structure 10 are identified by similar reference numerals but 100 higher.

In connection with the forming of the hose connector or cuff with either of the disclosed terminal support devices, or holders, the terminals and holder or substrate are effectively maintained in the desired disposition within the mold by suitable dowel means carried by the mold. In the first described embodiment, the dowel means utilizes cooperating recess means of the holder and in the second embodiment, the dowel means utilizes the internal bores of the terminals themselves in effecting this desired alignment. This improved method of manufacturing the hose connectors provides a facilitated low cost, highly accurate manufacture wherein the terminals are effectively maintained in the desired disposition within the molded cuffs at all times against displacement as by forces acting transversely thereto, such as from the springiness of the hose conductor wires. The dowel pins cooperate with the forward surface of the holder in further maintaining the desired disposition of the holder and terminals in the hose connector structure and in maintaining the entrance opening to the terminals from exteriorly of the complete hose connector for receiving the complementary terminals to be connected thereto.

As a result of the improved high accuracy in the positioning of the terminals in the hose structures of the present invention as exemplified by structures 10 and 110, and the positive maintenance of the terminals in the precise desired position thereafter, improved troublefree, long life of the hose end connectors is obtained while yet the hose structures are extremely simple and economical of manufacture.

While the invention has been illustrated in conjunction with a vacuum cleaner hose having a pair of electrical conductors included therein, it will be appreciated by those skilled in the art that with suitable modifications the invention may be utilized in hose structure including three or more electrical conductors.

The foregoing disclosure of specific embodiments is illustrative of the broad inventive concepts comprehended by the invention.

I claim:

1. In a vacuum cleaner hose structure having a flexible hose portion defined by a tubular carcass having a plurality of coaxially spaced, helical spring wire electrical conductors included therein, said hose portion defining an end, electrical terminal means connected to said electrical conductors at said end of the hose portion comprising:

a plurality of electrical terminals each having a connecting portion, said terminals being mechanically and electrically connected one each to each one of said electrical conductors at said hose portion end;

a support device supporting said terminals in preselected spaced relationship; and a cuff molded about said hose portion end, said electrical conductors at said hose portion end, and said support device, said terminal connecting portions being accessible for separable engagement with complementary electrical terminals for providing a separable electrical connection to said electrical conductors, said support device including a first portion supporting said connecting portion of the electrical terminals, and a second portion defining means for retaining the terminals connected to said conductors, said support device further having a third portion defining means arranged to prevent displacement of the support device during formation of the cuff, said second portion being movably connected to said first portion, said second portion further having latch means for holding the second portion in a retaining disposition about said hose portion end, electrical conductors, and electrical terminal second portions connected to said electrical conductors.

2. In a vacuum cleaner hose structure having a flexible hose portion defined by a tubular carcass having a pair of coaxially spaced, helical spring wire electrical conductors included therein, said hose portion defining an end, electrical terminal means connected to said electrical conductors at said end of the hose portion comprising:

a first electrical terminal having a first connecting portion, and a second sharp edge portion mechanically and electrically connected to one of said electrical conductors at said hose portion end;

a second electrical terminal having a first connecting portion, and a second sharp edge portion mechanically connected to the other of said electrical conductors at said hose portion end;

a support device for supporting said terminals in preselected spaced relation, said support device comprising a one-piece member having a wall portion, said electrical terminal connecting portions being installed one each in said wall portion; and a cuff molded about said hose portion end, said electrical conductors at said hose portion end, and said support device, said terminal connecting portions being exposed for separable engagement with complementary electrical terminals for providing a separable electrical connection to said electrical conductors, said member further defining a locating recess arranged to receive a dowel pin for holding the member during the molding of the cuff.

3. In a vacuum cleaner hose structure having a flexible hose portion defined by a tubular carcass having a pair of coaxially spaced, helical spring wire electrical conductors included therein, said hose portion defining an end, electrical terminal means connected to said electrical conductors at said end of the hose portion comprising:

a first electrical terminal having a first connecting portion, and a second sharp edge portion mechanically and electrically connected to one of said electrical conductors at said hose portion end;

a second electrical terminal having a first connecting portion, and a second sharp edge portion mechanically connected to the other of said electrical conductors at said hose portion end;

a support device for supporting said terminals in preselected spaced relation, said support device comprising a one-piece member having a wall portion, said electrical terminal connecting portions being installed one each in said wall portion; and a cuff molded about said hose portion end, said electrical conductors at said hose portion end, and said support device, said terminal connecting portions being exposed for separable engagement with complementary electrical terminals for providing a separable electrical connection to said electrical conductors, said support device defining an outer planar face, said support device further defining a locating recess arranged to receive a dowel pin for holding the support device during the molding of the cuff, said openings and recess opening outwardly through said face.

4. In a vacuum cleaner hose structure having a flexible hose portion defined by a tubular carcass having a pair of coaxially spaced, helical spring wire electrical conductors bonded thereto, said hose portion defining an end, electrical terminal means connected to said electrical conductors at said end of the hose portion comprising:

a first electrical terminal having a first connecting portion, and a second sharp edge portion mechanically and electrically connected to one of said electrical conductors at said hose portion end;

a second electrical terminal having a first connecting portion, and a second sharp edge portion mechanically and electrically connected to the other of said electrical conductors at said hose portion end;

a support device for supporting said terminals in preselected spaced relationship, said support device comprising a base, an upright wall on the base having a pair of through openings, and retaining wall means connected to the base to be disposed selectively in a retaining disposition wherein the retaining wall effectively retains portions of the terminals connected to said conductors; and a cuff molded about said hose portion end, said electrical conductors at said hose portion end, and said support device, said terminal connecting portions being exposed for separable engagement with complementary electricial terminals for providing a separable electrical connection to said electrical conductors, said cuff further holding said retaining wall means in said retaining disposition.

5. The vacuum cleaner hose structure of claim 4 wherein said retaining wall means is movably connected to said base.

6. The vacuum cleaner hose structure of claim 4 wherein said retaining wall means and base further define latch means for holding the retaining wall means in said retaining disposition about said hose portion end, electrical conductors, and electrical terminal second portions connected to said electrical conductors during molding of the cuff thereabout.

7. The vacuum cleaner hose structure of claim 4 wherein said retaining wall means is movably connected to said upright wall.

8. The vacuum cleaner hose structure of claim 4 wherein said base includes an outer portion provided with semicylindrical recesses receiving the outer ends of the connecting portions of the terminals.

9. The method of forming a hose connector on the end of a vacuum cleaner hose having a plurality of helical springy electrical conductors and electrical terminals wedged onto the electrical conductors at said end, the terminals defining connection portions, said method comprising the steps of:

providing a terminal holder having an alignment portion and means for preventing translation thereof during molding of a hose connector thereabout;

engaging the terminals with said holder to be retained thereby in accurate spaced relationship;

providing a mold having aligning means complementary to said alignment portion of the holder;

placing the hose end with the terminals wedged onto the electrical conductors and retained in said accurate spaced relationship by the holder into said mold with the alignment portion of the holder engaging said aligning means for causing the holder to be accurately positioned in the mold thereby;

molding a hose connector to said hose end about said terminals and holder with translation preventing means preventing translation of the terminals and holder during the molding step; and separating the molded hose connector from the mold, said terminal connecting portions being exposed to outwardly of the hose connector upon removal of the hose connector from the mold and being further maintained in said accurately spaced relationship notwithstanding softness of the molded cuff at the time of such removal, said holder alignment portion comprising a recess in the holder and said mold aligning means comprising a projection adapted to accurately removably fit said recess.

10. The method of forming a hose connector on the end of a vacuum cleaner hose having a plurality of helical springy electrical conductors and electrical terminals wedged onto the electrical conductors at said end, the terminals defining connection portions, said method comprising the steps of:

providing a terminal holder having an alignment portion and means for preventing translation thereof during molding of a hose connector thereabout;

engaging the terminals with said holder to be retained thereby in accurate spaced relationship;

providing a mold having aligning means complementary to said alignment portion of the holder;

placing the hose end with the terminals wedged onto the electrical conductors and retained in said accurate spaced relationship by the holder into said mold with the alignment portion of the holder engaging said aligning means for causing the holder to be accurately positioned in the mold thereby;

molding a hose connector to said hose and about said terminals and holder with translation preventing means preventing translation of the terminals and holder during the molding step; and separating the molded hose connector from the mold, said terminal connecting portions being exposed to outwardly of the hose connector upon removal of the hose connector from the mold and being further maintained in said accurately spaced relationship notwithstanding softness of the molded cuff at the time of such removal, said holder alignment portion comprising a recess in the holder adjacent said terminal connecting portions and said mold aligning means comprising a projection adapted to accurately removably fit said recess.

* * * * *